United States Patent [19]

Hanson et al.

[11] Patent Number: 4,500,773

[45] Date of Patent: Feb. 19, 1985

[54] METHOD AND APPARATUS FOR USE IN HEATING SHOE PARTS

[75] Inventors: Raymond Hanson, Rearsby; Malcolm Tillyard, Leicester, both of England

[73] Assignee: USM Corporation, Farmington, Conn.

[21] Appl. No.: 325,384

[22] Filed: Nov. 27, 1981

[30] Foreign Application Priority Data

Nov. 29, 1980 [GB] United Kingdom ..... 8038412

[51] Int. Cl.[3] ..... A43D 95/10; H05B 1/00

[52] U.S. Cl. ..... 219/215; 12/1 R; 219/354; 219/357

[58] Field of Search ..... 219/215, 342, 348, 350, 219/351, 352, 353, 354, 357, 358; 12/1 R, 33.2; 156/272.2, 275.5, 275.7, 499

[56] References Cited

U.S. PATENT DOCUMENTS

| | | | |
|---|---|---|---|
| 1,258,633 | 3/1918 | Heath | 219/215 |
| 1,535,394 | 4/1925 | Baynard et al. | 219/215 |
| 2,081,648 | 5/1937 | Suerken | 219/215 |
| 2,522,021 | 9/1950 | Dewey | 12/33.2 |
| 2,582,464 | 1/1952 | Small | 219/215 |
| 2,672,545 | 3/1954 | Alderman et al. | 219/215 |
| 3,030,484 | 4/1962 | Anniss et al. | 219/215 |
| 3,105,891 | 9/1963 | Gibbard et al. | 219/385 |
| 3,171,161 | 3/1965 | Hardy | 219/215 |
| 3,256,420 | 6/1966 | Werman | 219/215 |
| 3,517,160 | 6/1970 | Maga | 219/215 |
| 3,604,036 | 9/1971 | Dunlap | 12/1 R |
| 4,284,874 | 8/1981 | Prichard et al. | 219/358 |

FOREIGN PATENT DOCUMENTS

| | | | |
|---|---|---|---|
| 215576 | 6/1958 | Australia | 12/33.2 |
| 700768 | 12/1953 | United Kingdom | 219/385 |

*Primary Examiner*—Roy N. Envall, Jr.
*Assistant Examiner*—Geoffrey S. Evans
*Attorney, Agent, or Firm*—Donald N. Halgren

[57] ABSTRACT

A metal plate is heated to bring a heating surface thereof to a temperature of between 450° C. and 300° C. The shoe part to be heated is brought into opposed relationship with and close proximity to the heating surface. This method avoids color sensitivity problems and the necessity to adjust heaters to the shape of the shoe part. Apparatus for carrying out the method may have a support for a shoe on one side of the metal plate and a support for a sole to be attached to the shoe on the other side thereof.

13 Claims, 5 Drawing Figures

60
62
67
71
66
70
58
64
70
68
74
52
72
56
54
12

METHOD AND APPARATUS FOR USE IN HEATING SHOE PARTS

BACKGROUND OF THE INVENTION

1. Field of the Invention

This invention is concerned with a method and apparatus for use in heating shoe parts to activate adhesive on a surface thereof.

2. Prior Art

In the shoe industry, it is frequently necessary to heat a shoe part to activate adhesive thereon before adhering the part to another shoe part. For example, a shoe sole may require heating before being pressed on to a shoe to adhere the sole to the shoe. The word "shoe" where used herein is to be understood as referring to outer footwear generally whether complete or in the course of manufacture. At present this heating is usually performed by exposing the shoe part to a bank of infra-red heaters.

The infra-red heaters used at present have the disadvantage that they are color sensitive, i.e. lighter colored materials heat less rapidly than darker colored materials, so that the time for which materials are exposed to the heaters has to be varied with different colors of material. This disadvantage is caused by lack of uniformity between the degrees by which the various colors of material absorb the radiation emitted by these heaters. One example of such a heater has a bank of tubular quartz lamps having a filament operating temperature of approximately 2100° C. and a radiation output which has wavelengths between 0.6 and 4.7 microns.

A further disadvantage of the present heaters is experienced when the shoe part to be heated does not have a planar surface. In this case, the distances between the shoe part and the heaters in the bank have to be made approximately equal to avoid differential heating of the shoe part and this involves adjustment of the relative heights in the bank.

It is an object of the present invention to provide a method and apparatus for use in heating shoe parts in which the above-mentioned disadvantages are avoided.

BRIEF SUMMARY OF THE INVENTION

The invention provides a method of heating a shoe part to activate adhesive on a surface thereof, the method comprising heating a metal plate so that a heating surface thereof which is of greater extent than the surface of the shoe part to be heated reaches a temperature of between 450° C. and 300° C., and bringing the surface of the shoe part into opposed relationship with and close proximity to the heating surface of the metal plate.

The invention also provides an apparatus, suitable for use in a method according to the last preceding paragraph, comprising a metal plate having electrical heaters embedded therein which are operable to heat the plate, control means operable to control the heaters so that they bring the heating surface to a temperature of between 450° C. and 300° C. and maintain it substantially at that temperature, and a support for a shoe part on which a shoe part can be positioned in opposed relationship with and close proximity to the heating surface of the metal plate.

The invention also provides an apparatus for use in heating shoe parts to activate adhesive on surfaces thereof, the apparatus comprising a metal plate having electrical heaters embedded therein which are operable to heat the plate, control means operable to control the heaters so that they bring two heating surfaces of the plate to a temperature of between 450° C. and 300° C. and maintain them substantially at that temperature, a support for a shoe on which a shoe can be positioned in opposed relationship and close proximity to one of the heating surfaces, and a support for a sole on which a sole can be positioned in opposed relationship and close proximity to the other heating surface.

In order to achieve low color sensitivity combined with low heating times, it is advantageous if the heating surface of the plate is brought to a temperature of between 400° C. and 360° C.

In order to avoid differential heating when heating relatively large shoe parts, it is advantageous if the temperature of the heating surface is uniform over the surface to within 10° C.

To increase ease of operation of an apparatus according to the invention, it is advantageous if the support for a shoe part is mounted for movement between a loading position and an operative position in which a shoe part supported thereby is in opposed relationship and close proximity to the heating surface of the metal plate, and the apparatus comprises timing means operable, when the support is moved into its operative position, to hold it there for a predetermined time and then return it to its loading position.

Where the shoe part to be heated is a sole, it is advantageous if the support for a shoe part comprises a heel support which is pivotally adjustable relative to the remainder of the support, the heel support being arranged to support the heel of a sole supported by the support and comprising a plurality of parallel cords stretched across a frame, the arrangement being such that a heel can be supported with at least one of the cords engaging its rear surface. To ensure that the heel is not damaged by the cords, it is advantageous if the cords are made of fiber glass coated with silicon rubber.

DESCRIPTION OF THE DRAWINGS

There now follows a detailed description, to be read with reference to the accompanying drawings, of a method and apparatus for use in heating shoe parts which are illustrative of the invention. It is to be understood that the illustrative method and the illustrative apparatus have been selected for description by way of example and not of limitation of the invention.

In the drawings.

DESCRIPTION OF THE PREFERRED EMBODIMENT

Figure 1:
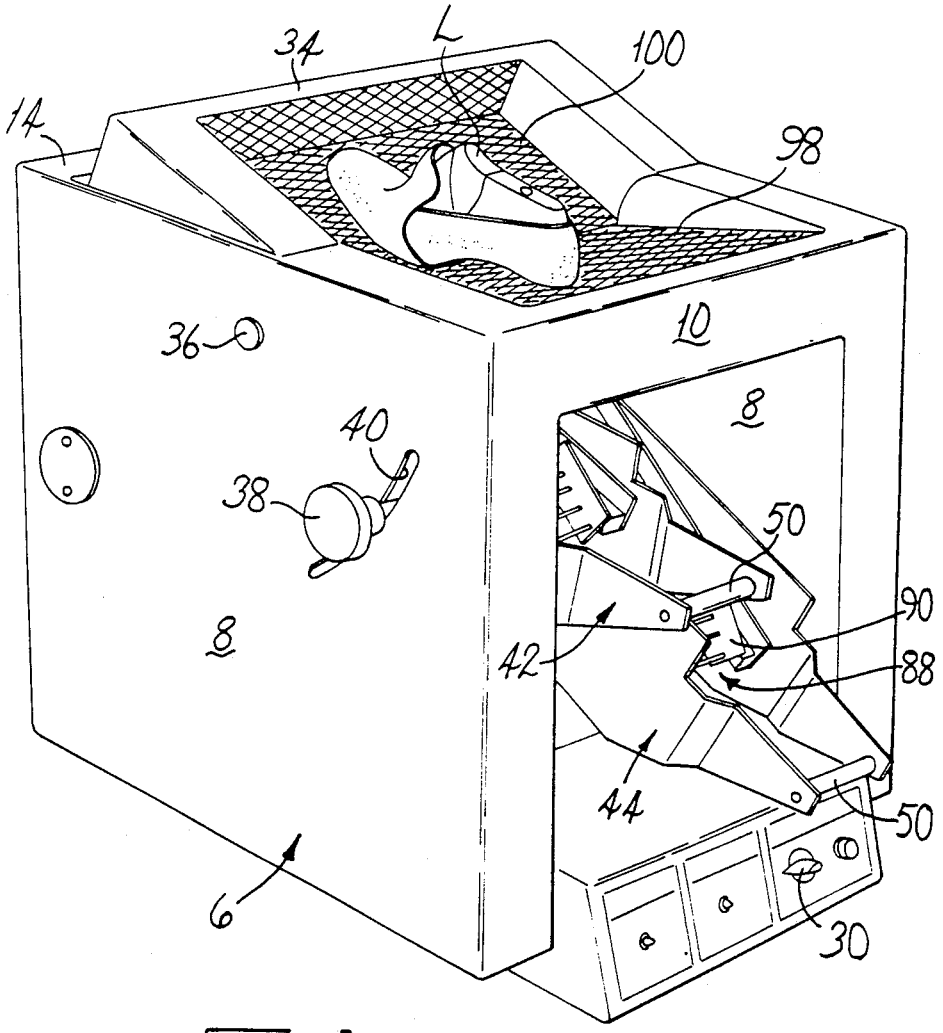
FIG. 1 is a perspective view of the illustrative apparatus.

The illustrative apparatus comprises a supporting framework 6 having two side members 8, an upper front cross member 10 extending between the members 8, a base 12 (FIG. 2) and a rear member 14 extending upwardly from the base 12 and between the side members 8.

Figure 4:
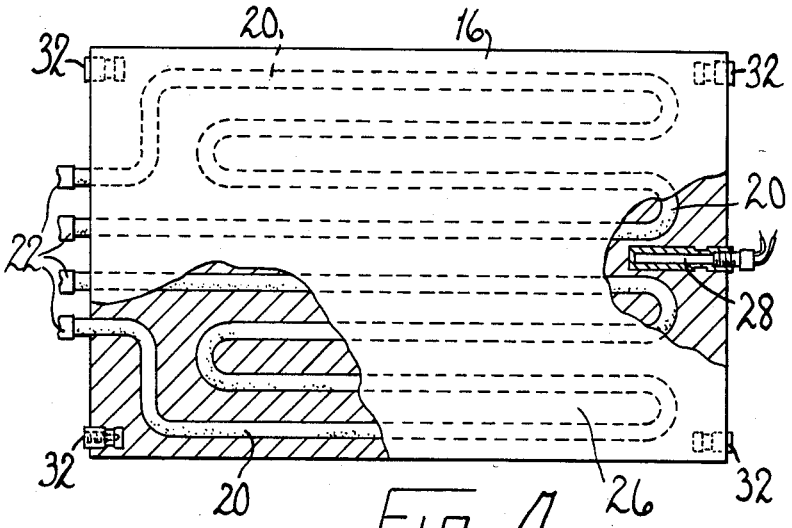
FIG. 4 is a plan view of a portion of a metal plate of the illustrative apparatus.

The illustrative apparatus comprises a metal plate having a front portion 16 and a rear portion 18, the two portions 16 and 18 being identical. The portion 16 is shown in FIG. 4 and is made of aluminium cast around electrical heaters 20 which are, therefore, embedded in the metal plate. The heaters 20, of which there are two in each portion 16 and 18, follow a sinusoidal course through the portion (See FIG. 4) ending at electrical connectors 22 by which the heaters are connected to a power source (not shown). The heaters 20 are operable to heat the metal plate and are arranged to bring a lower heating surface 24 and an upper heating surface 26 of the metal plate to a temperature which is uniform to within 10° C. over the surface. To achieve this, the heaters 20 are located in the center of the portions 16 and 18 which are 2 cms. thick and the centers of adjacent coils of the heaters 20 are 2.5 cms apart. The portions 16 and 18 also each contain a thermostat 28 which forms control means operable to control the heaters 20 so that they bring the surfaces 24 and 26 to a temperature of approximately 380° C. and maintain it substantially at that temperature. The heating surfaces 24 and 26 are blackened to improve their ability to radiate.

Figure 2:
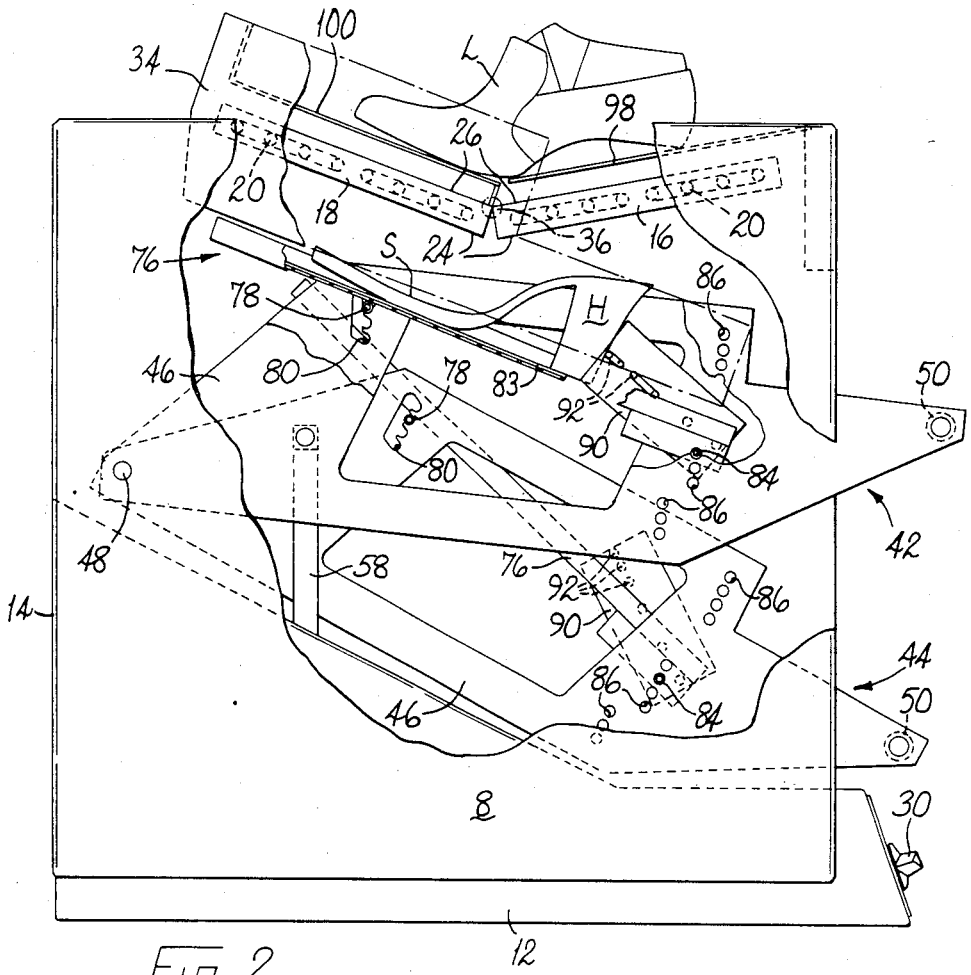
FIG. 2 is a side view of the illustrative apparatus, with parts broken away.

The temperature to which the heating surfaces 24 and 26 are brought is selected so that most of the infra-red radiation given off by the surfaces has a wavelength above 3.4 microns. This is because it is found that wavelengths below 3.4 microns are absorbed to differing extents by different colors of shoe part while at wavelengths above 3.4 microns this "color sensitivity" is substantially eliminated. We have found that a practical upper limit for the temperature if color sensitivity is to be eliminated to a substantial degree is 450° C. Thus, the temperature of the surfaces 24 and 26 can be controlled to be any temperature between 450° C. and the lowermost temperature at which practical heating times can be achieved, which we have found to be 300° C. The best results are achieved, however, if the heating surfaces 24 and 26 are brought to a temperature of between 400° C. and 360° C. and maintained substantially at that temperature. If necessary, the temperature can be adjusted by means of a control 30. The front portion 16 of the metal plate is fixed, by means of fixing members 32 embedded therein, to the side members 8 so that it extends between the side members 8 at a front upper portion of the apparatus. The portion 16 is fixed so that it is inclined downwardly and rearwardly at an angle of 10°. The rear portion 18 is fixed to a frame 34 which is pivotally mounted on an axle formed by a pin 36 supported by each of the side members 8 in alignment with the rear of the portion 16 (FIG. 2). The frame 34 can be pivoted through an arc about the pins 36 and clamped in position by means of two clamping screws 38 carried by the frame 34 and which move in arcuate slots 40 in the side members 8. The two portions 16 and 18 are supported close to one another so that they form a metal plate hinged at its center so that the angle between the two portions 16 and 18 can be adjusted.

The illustrative apparatus also comprises supports for shoe parts on which shoe parts can be positioned in opposed relationship with and close proximity to the heating surfaces 24 and 26 of the metal plate. These supports comprise two supports 42 and 44 for shoe soles which are identical and only the support 42 will be fully described, the support 44 being given identical reference numbers for identical parts in the drawings.

The support 42 comprises a frame 46 which is mounted for pivotal movement about an axle 48 supported by the side members 8 at a rearward portion of the illustrative apparatus and below the level of the metal plate 16 and 18. The pivotal mounting of the frame 46 causes the support 42 to be mounted for pivotal movement between a loading position (in which the support 44 is shown in the drawings) and an operative position (in which the support 42 is shown). In the operative position of the support 42, a shoe sole S supported thereby (FIG. 2) is in opposed relationship with close proximity to the lower heating surface 24 of the metal plate. The frame 46 supports a handle 50 at a front portion thereof by which the support 42 can be moved from its loading position to its operative position.

Figure 3:
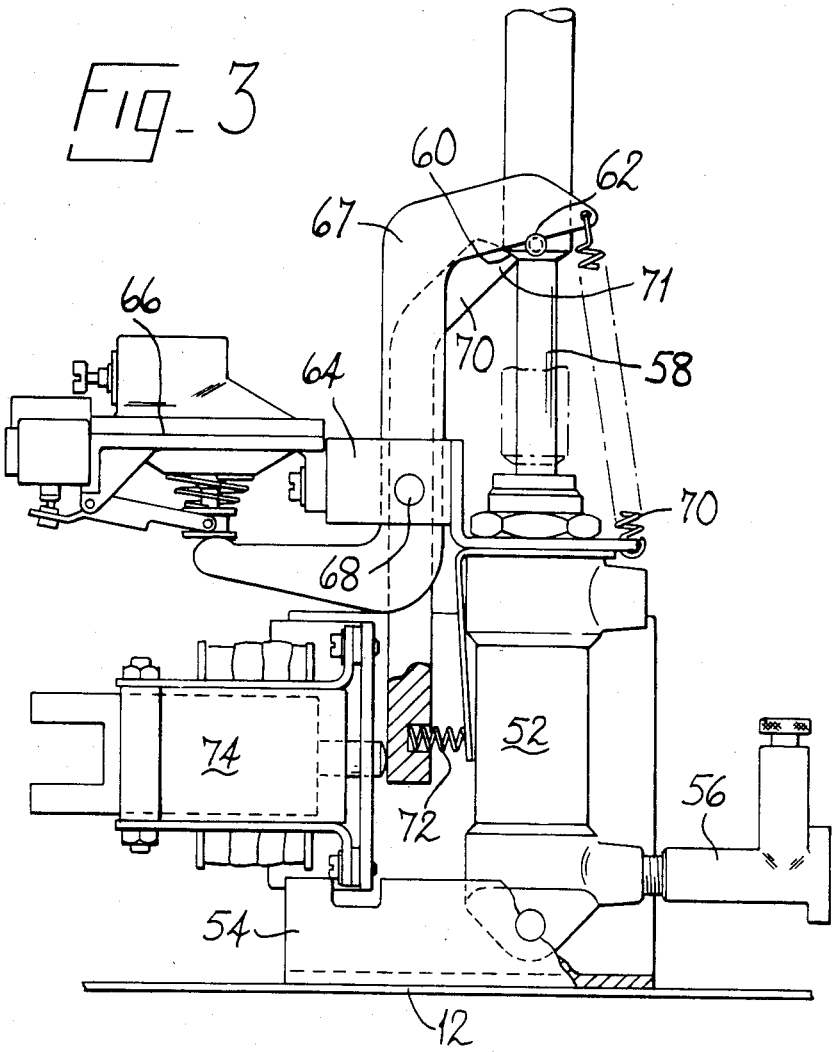
FIG. 3 is a detail view of timing means of the illustrative apparatus.

The illustrative apparatus also comprises timing means (FIG. 3) operable, when the support 42 is moved into its operative position, to hold the support 42 there for a predetermined time and then return it to its loading position. The timing means (of which there is one for each support 42 and 44) comprises a piston and cylinder assembly 52 which is pivotally mounted on a bracket 54 fixed to the base 12. The cylinder of the assembly has an inlet and outlet port beneath its piston connected to the atmosphere through a restrictor 56 which serves to slow down the movement of air into and out of the cylinder. A piston rod 58 extends upwardly from the piston of the assembly 52 and is pivotally connected at its upper end to the frame 46. The piston rod 58 has a shoulder 60 thereon and a pin 62 which projects horizontally therefrom. Mounted on top of the assembly 52 is a bracket 64 which supports an electrical timer 66 having a start lever 67 arranged when operated to cause the timer 66 to start timing a predetermined period.

The start lever 67 is pivotally mounted on a pin 68 supported by the bracket 64 and is biased against the timer 66 by a spring 70. The arrangement is such that, as the support 42 is moved to its operative position, the pin 62 engages the lever 67 pivoting it away from the timer 66 and causing it to start timing. Also pivoted on the pin 68 is a latch 69 which has an upper end portion 71 which is biased against the piston rod 58 by a spring 72. The arrangement is such that, when the support 42 reaches its operative position, the upper end portion 71 moves under the shoulder 60 of the piston rod 58 and serves to hold up the piston rod 58 to hold the support 42 in its operative position. When the predetermined period finishes, the timer 66 operates a solenoid 74 which pivots the latch 69 against the spring 72 so that the end portion 71 is removed from beneath the shoulder 60, whereupon the support 42 falls to its loading position with its movement damped by the action of the restrictor 56. The timing means may hold the support 42 in its operative position for between 4 and 8 seconds but 5 seconds has been found to be a suitable period for a wide range of soles.

Figure 5:
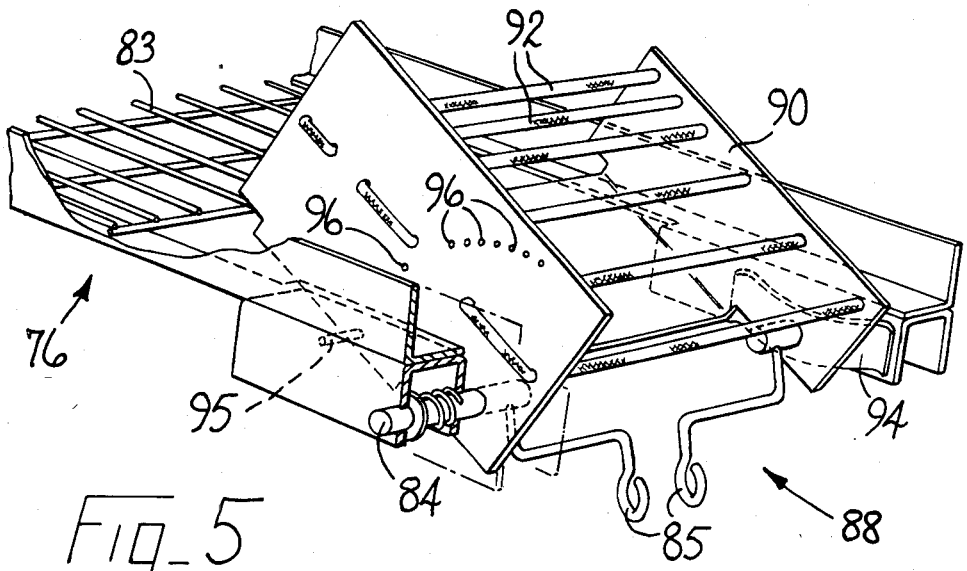
FIG. 5 is a perspective view of a portion of a support of the illustrative apparatus.

The frame 46 of the support 42 supports a tray 76 on which a shoe sole S is positioned to be supported by the support 42. The tray 76 comprises a wire mesh support surface 83 and is supported on the frame 46 at two points, firstly a bar 78 at a forward portion thereof is received in one of four alternative grooves 80 in holes 82 in the frame 46, each end of the bar 78 is received in a groove 80 of a hole 82 of the frame 46; and secondly the tray 76 carries two spring-loaded pins 84 which are received into any of a number of circular holes 86 in the frame 46, there being a handle 85 attached to each pin 84 by which it can be removed from the holes 86 (see FIGS. 2 and 5). The arrangement is such that, an operator of the illustrative apparatus can, by altering which grooves 80 are occupied by the bar 78 and which holes 86 are occupied by the pins 84, adjust the tray 76 and therefore of the operative position of the support 42 towards or away from the heating surface 24 of the metal plate. Furthermore, pivotal adjustment of the tray 76 of the support 42 relative to the heating surface 24 can also be achieved by these alterations.

At a rearward portion thereof, the tray 76 has a heel support 88 pivotally mounted thereon. The heel support 88 comprises a frame 90 (see FIGS. 1, 2 and 5) across which a plurality, viz. six, of cords 92 are stretched. The frame 90 is pivotal on the pins 84 so that it is pivotally adjustable relative to the remainder of the tray 76 and is held in position by a leaf spring 94 which urges the frame 90 sideways relative to the tray 76 so that a pin 95 carried by the tray 76 (see FIG. 5) enters one of a series of holes 96 in the frame 90. The heel support 88 is arranged to support the heel H of a shoe sole S supported by the support 42, the arrangement being such that the heel H can be supported with at least one of the cords engaging its rear surface (as shown in FIG. 2). The heel support 88 can be pivoted above or below the plane of the remainder of the tray 76 and, in the case of some heels H, one or more of the cords 92 may engage the ground-engaging surface of the heel H. The cords 92 are made of fiber glass coated with silicon rubber which will stand the required temperatures without marking the heel H.

The illustrative apparatus also comprises a further support for a shoe part, in the form of a lasted shoe L, on which a shoe L can be positioned in opposed relationship with and close proximity to the upper heating surface 26 of the metal plate. The shoe L is to have the sole S attached thereto and, in the operation of the illustrative apparatus the shoe L and the sole S can be simultaneously heated by the heating surfaces 24 and 26. The further support comprises a mesh 98 supported 1 cm above and parallel to the portion 16 of the metal plate by the side members 8 and a mesh 100 supported by the frame 34 1 cm above and parallel to the portion 18 of the metal plate. Since the mesh 100 pivots with the frame 34, the support is hinged and can be adjusted by movement of the frame 34 to support various shoes L. The meshes 98 and 100 allow infra-red radiation from the surface 26 to pass therethrough to reach the shoe L.

The illustrative method of heating a shoe part to activate adhesive on a surface thereof will now be described; the illustrative apparatus is used in carrying out the illustrative method. In the illustrative method, both the shoe L and the sole S to be attached thereto are heated but it will be understood that a method according to the invention could be used to heat a single shoe part.

The illustrative method comprises using the screws 38 to hinge the mesh 100 so that the meshes 98 and 100 can support the shoe L with the toe portion of the shoe L on the mesh 100 and the heel seat portion of the shoe on the mesh 98 (as shown in FIGS. 1 and 2). The adjustment of the mesh 100 also adjusts the portion 18 of the metal plate so that the heating surface 26 is as nearly parallel as is possible to the lower surface of the shoe L. Next, the operator adjusts the support 42 so that the sole S will be correctly supported thereby. To do this, he adjusts the heel support 88 pivotally in accordance with the shape of the heel H, then he pivots the tray 76 and adjusts its height in accordance with the shape of the upper surface of the sole S and the thickness of the sole S. In pivoting the tray 76, the operator seeks to bring the forwardmost portion and the rearwardmost portion of the upper surface of the sole S to approximately equal distance from the heating surface 24 when the support 42 is in its operative position.

Next, in the illustrative method, the metal plate is heated so that the heating surfaces 24 and 26 thereof, which are of greater extent than the sole S or the shoe L so that uneven heating at the edges is avoided, reach a temperature of between 450° C. and 300° C., the specific temperature being 380° C. which is within the preferred range of 400° C. to 360° C.

Next, in the illustrative method, the shoe L and the sole S are brought into opposed relationship with and close proximity to the heating surfaces 24 and 26 of the metal plate. This is done by positioning the shoe L on the meshes 98 and 100 and placing the sole S on the support 42 at its loading position and moving it to its operative position so that the shoe L and the sole S are simultaneously heated. After 5 seconds, the support 42 returns to its loading position and the shoe L and the sole S can be removed for attachment.

Since the heating surfaces 16 and 18 are uniform in temperature over the surfaces to within 10° C., differential heating of the shoe part is avoided despite the fact that the distance between the shoe part and the heating surface is not constant. Furthermore, since most of the infra-red radiation used has a wavelength above 3.4 microns, a wide range of shoe parts can be heated without adjustment of the timing means.

We claim:

1. A method of heating shoe parts to activate adhesive on a surface thereof, the method comprising:

heating a single articulated continuous planar heating plate, having top and bottom surfaces which are each of greater extent than the surface of a shoe part, to a temperature of between 300° C. and 450° C.; and bringing the adhesive coated surface of a shoe part into opposed relationship with and close proximity to a selected one of the surfaces of the heating plate.

2. A method according to claim 1 including: heating the surfaces of the articulated continuous planar heating plate to a temperature of between 360° C. and 400° C.

3. A method according to claim 2 including: heating the temperature of the surfaces uniformly over the surface to within 10° C.

4. A method according to claim 1 wherein a timing means is operable to hold a shoe support in its operative position between 4 and 8 seconds.

5. An apparatus suitable for use in heating shoe parts to activate adhesive on a surface thereof, comprising:

a single continuous plate comprising a pair of articulated portions, each having upper and lower surfaces, and each having electrical heaters embedded therein which are operable to heat the plate;

control means operable to control the heaters so that they bring both the upper and lower heating surfaces of the plate to a temperature of between 300° C. and 450° C. and maintain them substantially at that temperature; and adjustable support means for shoe parts, on which shoe parts can be positioned in opposed relationship with and close proximity to the upper and the lower heating surfaces of the single continuous articulated plate.

6. Apparatus according to claim 5 wherein the heaters are arranged to bring the heated surfaces to a temperature which is uniform to within 10° C. over the surface.

7. Apparatus according to claim 5 wherein the control means is operable to control the heaters so that they bring the heated surfaces to a temperature of between 360° C. and 400° C. and maintain it substantially at that temperature.

8. Apparatus according to claim 5 wherein the support for a shoe part is mounted for movement between a loading position and an operative position in which a shoe part supported thereby is in opposed relationship and close proximity to a heated surface of the plate.

9. Apparatus according to claim 8 wherein the apparatus comprises timing means operable, when the support is moved into its operative position, to hold it there for a predetermined time and then return it to its loading position.

10. Apparatus according to claim 5 wherein the supports of the apparatus are arranged to support a sole and a shoe to which the sole is to be attached so that the shoe and sole can be simultaneously heated by the heated surfaces.

11. An apparatus for use in heating shoe parts to activate adhesive on surfaces thereof, the apparatus comprising:

a single continuous plate with articulated portions having upper and lower sides each having electrical heating elements embedded therein which are operable to heat the plate, control means operable to control the heating elements so that they bring both the upper and lower sides of the articulated plate to a temperature of between 300° C. and 450° C. and maintain them substantially at that temperature;

an adjustable support for a shoe on which a shoe can be positioned in opposed relationship and close proximity to either the upper or the lower side of the single continuous heated plate, and;

an adjustable support for a sole on which a sole can be positioned in opposed relationship and close proximity to the other side of the single continuous heated plate.

12. Apparatus according to claim 11 wherein the control means is operable to control the heating elements so that they bring the two heating surfaces to a temperature of between 360° C. and 400° C.

13. Apparatus according to claim 11 wherein the plate is made of aluminum cast around the heating elements.

* * * * *